US005950736A

United States Patent [19]

Goldstein

[11] Patent Number: 5,950,736

[45] Date of Patent: Sep. 14, 1999

[54] METHOD AND APPARATUS FOR IMPROVING DRILLING EFFICIENCY BY APPLICATION OF A TRAVELING WAVE TO DRILLING FLUID

[75] Inventor: Yeshayahu S. Goldstein, Gaithersburg, Md.

[73] Assignee: APTI Inc.

[21] Appl. No.: 08/937,446

[22] Filed: Sep. 26, 1997

[51] Int. Cl.[6] ..... E21C 37/12

[52] U.S. Cl. ..... 175/1; 175/56; 175/205; 299/17

[58] Field of Search ..... 175/1, 205, 212, 175/217, 56; 299/17

[56] References Cited

U.S. PATENT DOCUMENTS 3,405,770 10/1968 Galle et al. ..... 175/56
3,521,820 7/1970 Cooley ..... 299/17

*Primary Examiner*—William Neuder
*Assistant Examiner*—Chi H. Kang
*Attorney, Agent, or Firm*—Rossi & Associates

[57] ABSTRACT

A drilling apparatus includes a drill string, a drilling head located at a first end of the drill string, a drilling fluid pump located at a second end of the drill string, wherein the drilling fluid pump pumps a drilling fluid along the length of the drill string to the drilling head, and a traveling wave generator coupled to the drill string at a location downstream of the drilling fluid pump, wherein the traveling wave generator generates a series of ramped pressure pulses that are applied to the drilling fluid. The ramped pressure pulses are compressed by a reduction of the cross-sectional area of the drill string, and further by time compression caused by varying propagation rates of different portions of the pressure pulses pressure pulse if substantially formed at a surface of a drilling substrate. A shock wave associated with the compressed pressure pulse is generated substantially at the location of a surface of a drilling substrate. The traveling wave generator includes a gas chamber, a heating element located in the gas chamber, and a control unit for controlling the operation of the heating element to generate the ramped pressure pulses. A drilling rate detection mechanism is also provided to supply drilling rate data to the control unit, which adjusts the timing of the ramped pressure pluses based on the drilling rate data to control the formation point of the shock wave.

15 Claims, 4 Drawing Sheets

METHOD AND APPARATUS FOR IMPROVING DRILLING EFFICIENCY BY APPLICATION OF A TRAVELING WAVE TO DRILLING FLUID

FIELD OF THE INVENTION

The invention relates in general to drilling technology. More specifically, the invention relates to a method and apparatus for improving the efficiency of a drilling system by the introduction of a traveling wave into the drill string of a drilling fluid column by the application of a pressure pulse to a drilling fluid.

BACKGROUND OF THE INVENTION

The expense of oil and gas exploration and development is heavily dependent on the efficiency of the drilling system utilized to drill exploration wells to identify deposit sites and production wells to exploit the deposit sites once identified. It is therefore highly desirable to maximize drilling efficiency in terms of the effective overall speed of the drilling system. To this end, there have been many attempts to improve drilling efficiency by finding methods of assisting the direct drilling action of a drill bit utilized in the cutting of the substrate being drilled.

One type of conventional drilling system is referred to as rotary percussion drilling. Rotary percussion drilling is based on providing repeated percussion impacts or blows to a drill bit either through the drill string—commonly referred to as "top hammer" or at the location of the drill bit—commonly referred to as "down the hole"—as the drill bit is rotated and a thrust load or feed force is applied to the drill string. Flushing must also be provided in the rotary percussion drilling system to remove drill cuttings from the path of the bit as the bit is rotated and advanced under the force of the percussion impact, and is usually accomplished by providing a jet of water through an opening in the drill string. In a top hammer system, a hammer device is typically driven by compressed air to strike a shank of the drill string, which in turns imparts a shock wave to the drill string that travels to the bit. As drilling depths increase, however, it is increasing difficult to generate a shock wave of sufficient energy at the location of the bit.

In order to overcome the deficiencies of a top hammer system, a down the hole system drilling system was developed to apply a force directly to the drill bit at the bottom of the drill string. The down the hole drilling system incorporates a hydraulic or pneumatic piston hammer in the drill string at a location directly adjacent to the drill bit. Accordingly, the problem of dissipation of the shock wave experienced in top hammer drilling systems is overcome. However, as down the hole hammers are mechanical devices with moving components of some complexity, they are inevitably subject to wear or breakage and require periodic removal from the drill string for maintenance and repair, thereby slowing the overall drilling operation.

Due to the problems associated with both top hammer and down the hole drilling systems, alternative methods have been sought for improving drilling efficiency that would not rely on the mechanical transmission of a shock wave to a conventional roller bits. One such alternative method referred to as abrasive waterjet drilling utilized the additional of high pressure fluid jets to a conventional roller head to assist in breaking up or cutting the rock. For example, a drilling fluid including an abrasive such as a steel shot is forced from the fluid jets at high pressure to impact the rock surrounding the drill bit. Tests conducted using abrasive waterjet drilling showed that drilling rates could be significant improved over conventional rotary percussion drilling techniques. Drilling rates could only be maximized, however, when pressure and abrasive concentrations could be optimized at the bit. Accordingly, like rotary percussion drilling discussed above, abrasive waterjet drilling also exhibited a significant problem, namely, as the drill string became longer it became increasingly difficult to maintain the constant high pressures necessary over the entire length of the drill string to generate sufficient energy at the jets. Further, changes in pressure along the length of the drill string, due to temporary blockages at the nozzle or a change in fluid density, resulted in changes in the length of the drill string due to pressure differentials, which in turn caused overloading of the drill bit or lifting of the drill bit off the rock so drilling could not be maintained. In addition, problems were encountered in finding an effective method of introducing an abrasive into the drill fluid and recycling the abrasive for subsequent use. Accordingly, although the possibility of significant improvements in drilling rates were experimentally shown, further development of abrasive waterjet drilling was essentially abandoned.

In view of the above, it is an object of the invention to provide a drilling method and apparatus having improved efficiency that does not exhibit the drawbacks of conventional rotary percussion drilling and abrasive waterjet drilling discussed above.

SUMMARY OF THE INVENTION

The invention provides an improved drilling method and apparatus that incorporates the best elements of conventional drilling systems while avoiding the disadvantages associated therewith. In particular, the improved drilling method and apparatus supplies sufficient energy to fracture rock directly at the location of the drill bit as in a down the hole drilling system, but does not suffer the disadvantage of a down the hole system of having to located a complex mechanical device at the location of the drill bit. Instead, as in top hammer systems, the mechanism for generating the force necessary to create a shock wave at the drill bit is maintained above the surface of the drilling substrate to allow for easy access and maintenance, but does not suffer the disadvantage of dissipation of the shock wave at depth. Still further, in contrast to top hammer and waterjet systems, the improved method and apparatus can supply sufficient energy at the drill bit without requiring the drilling fluid to be subjected to high pressures along the entire length of the drill string.

The improved method and apparatus provides the advantages described above by introducing a traveling wave into the drill string by the application of a comparatively low pressure pulse to the drilling fluid. The pressure pulse is compressed by reducing the cross-sectional area of the drill string along its length. The pressure pulse is preferably ramped such that a higher pressure tail portion of the pulse catches up with a lower pressure head of the pulse at the location of the drill bit, due to differences in the propagation speeds of the tail portion and head portion through the drilling fluid. As a result, the ramped pressure pulse initially applied to the drilling fluid above the surface of the drilling substrate is compressed and magnified in amplitude to produce a high energy shock wave at the surface of the substrate being drilled.

In a preferred embodiment, a drilling apparatus is provided that includes a drill string, a drilling head located at a first end of the drill string, a drilling fluid pump located at a second end of the drill string, wherein the drilling fluid pump pumps a drilling fluid along the length of the drill string to the drilling head, and a traveling wave generator coupled to the drill string at a location downstream of the drilling fluid pump, wherein the traveling wave generator generates a series of ramped pressure pulses that are applied to the drilling fluid. The ramped pressure pulses are compressed by a reduction of the cross-sectional area of the drill string, and further by time compression caused by varying propagation rates of different portions of the pressure pulses pressure pulse if substantially formed at a surface of a drilling substrate. A shock wave associated with the compressed pressure pulse is generated substantially at the location of a surface of a drilling substrate. The traveling wave generator includes a gas chamber, a heating element located in the gas chamber, and a control unit for controlling the operation of the heating element to generate the ramped pressure pulses. A drilling rate detection mechanism is also provided to supply drilling rate data to the control unit, which adjusts the timing of the ramped pressure pluses based on the drilling rate data to control the formation point of the shock wave.

Further advantages and features of the invention will become apparent to those of ordinary skill in the art after review of the following detailed description of the preferred embodiments and the accompany drawings.

BRIEF DESCRIPTION OF THE DRAWINGS

The invention will be described in greater detail with reference to certain preferred embodiments thereof and the accompanying drawings, wherein.

DETAILED DESCRIPTION OF THE PREFERRED EMBODIMENTS OF THE INVENTION

Figure 1:
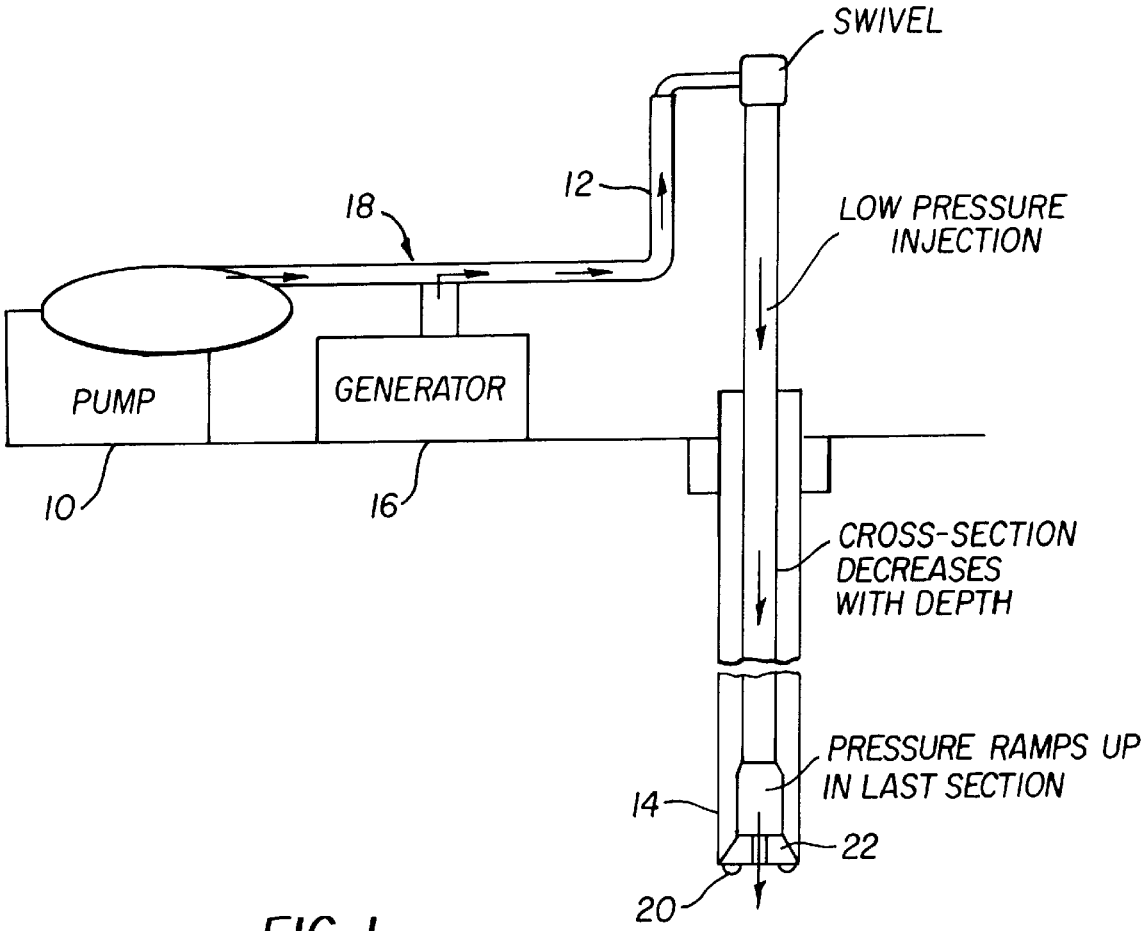
FIG. 1 is a schematic diagram illustrating the basic elements of a traveling wave drilling system in accordance with the invention.

FIG. 1 is a schematic diagram illustrating the basic elements of a traveling wave assisted drilling system in accordance with the invention, The system includes a conventional drilling fluid pump 10 coupled to a drill string 12 that terminates with a drilling head 14. A traveling wave generator 16 is coupled to the drill string 12 at a location downstream of the conventional drilling fluid pump 10. A check valve 18 is located in the drill string 12 between the output of the conventional drilling fluid pump 10 and the traveling wave generator 16, such that pressure pulses generated by the traveling wave generator 16 are prevented from traveling to the conventional drilling fluid pump 10.

Figure 2:
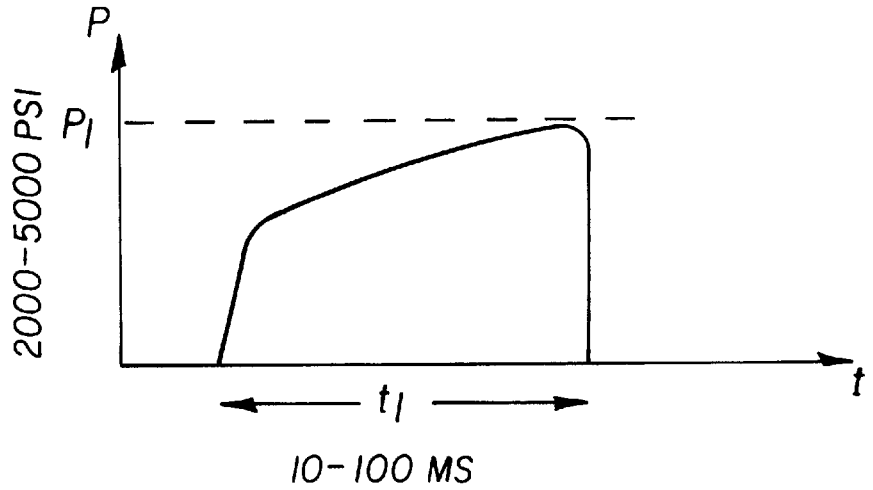
FIG. 2 is an illustration of a ramped pressure pulse in accordance with the invention.

The traveling wave generator 16 applies a ramped pressure pulse to a drilling fluid contained in the drill string 12 of the type illustrated in FIG. 2. The pressure pulse is preferably on the order of three hundred atmospheres above the background pressure provided by the conventional drilling fluid pump 10. The check valve 18 blocks the ramped pressure pulse from being transmitted to the conventional drilling fluid pump 10. Even though the output of the conventional drilling fluid pump 10 is temporarily blocked, normal operation of the pump can continue without interruption due to the short duration of the ramped pressure pulse, which is preferably on the order of between 10–100 milliseconds. The pressure pulse generated by the traveling wave generator 16 enters the drilling fluid provided in the drill string 12 and travels down to the drilling head 14, which preferably includes conventional drill bit elements 20 and one or more high pressure fluid jets 22 as shown the assisted drilling application illustrated in FIG. 1.

The application of a ramped pressure pulses to the drilling fluid results in a build up of compressed pressure pulses at the fluid jets 22, such that the drilling fluid exits the fluid jets 22 at very high velocity and cuts into the surrounding substrate. In addition, a shock wave from the compressed pressure pulses impacts the surface of the drilling substrate, thereby causing the substrate to fracture or weaken due to induced vibrations. The drilling fluid also acts to flush the drilling site to remove cut particles of the drilling substrate. As a result, the conventional drill bit elements 20 have an easier time penetrating the drilling substrate and overall drilling efficiency is improved.

The compressed pressure pulses formed by compressing the ramped pressure pulse applied to the drill string 12 by the traveling wave generator 16 as the ramped pressure pulse travels through the drill string 12. Compression is accomplished by decreasing the cross-sectional area of the inner diameter of the drill string 12 along its length. For example, in an ideal case, the inside diameter of the drill string is decreased from approximately 10 cm to approximately 1 cm at the outlet of the fluid jet 22 incorporated in the drilling head 14 with resulting increases in pressure as shown in Table 1.

TABLE 1

| I.D. | Length | Pressure |
|---|---|---|
| 10 cm | 3.7 km | 300 Atm. |
| 5 cm | 0.2 km | 600 Atm. |
| 2 cm | 0.1 km | 1500 Atm. |
| 1 cm | 0.01 km | 3000 Atm. |

Figure 3:
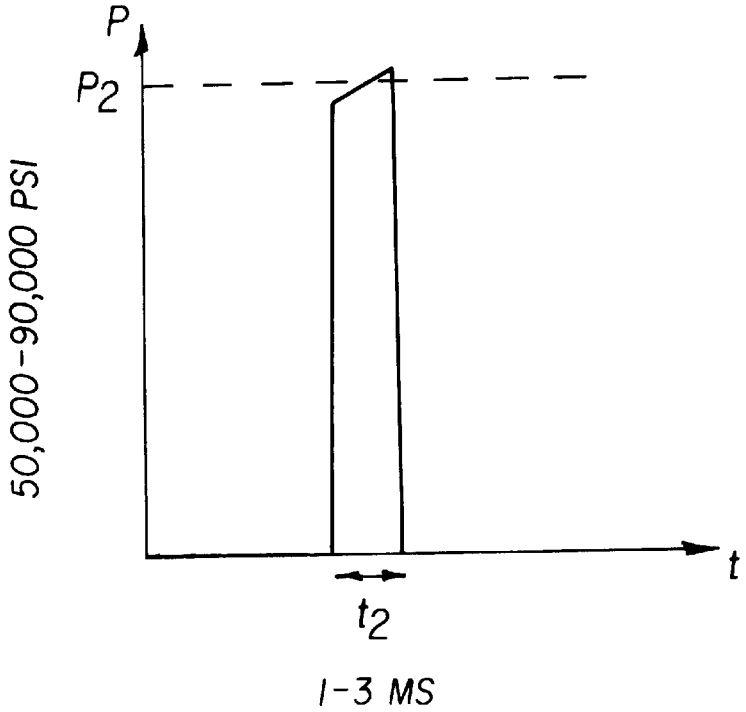
FIG. 3 is an illustration of compression of the ramped pressure pulse illustrated in FIG. 2.

In addition to changing the cross-sectional area, the ramped pressure pulses are also compressed as a result of the difference in the propagation speeds of the higher pressure tail of the pulse from the lower pressure head. For example, while the pressure pulse travels through the drilling fluid at the speed of sound, the speed of sound in the high pressure domain is faster than the speed of sound in the low pressure domain. Accordingly, the high pressure tail of the ramped pressure pulse catches up with the lower pressure head of the pressure pulse as the pressure pulse propagates through the drilling fluid along the length of the drill string. Thus, a maximum compressed pressure pulse of a type illustrated in FIG. 3 is preferably created at the drilling head 14 by the combination of compression by reduction in the cross-section of the drill string 12 and by time compression due to differences in the propagation time of various portions of the ramped pressure pulse.

Figure 4:
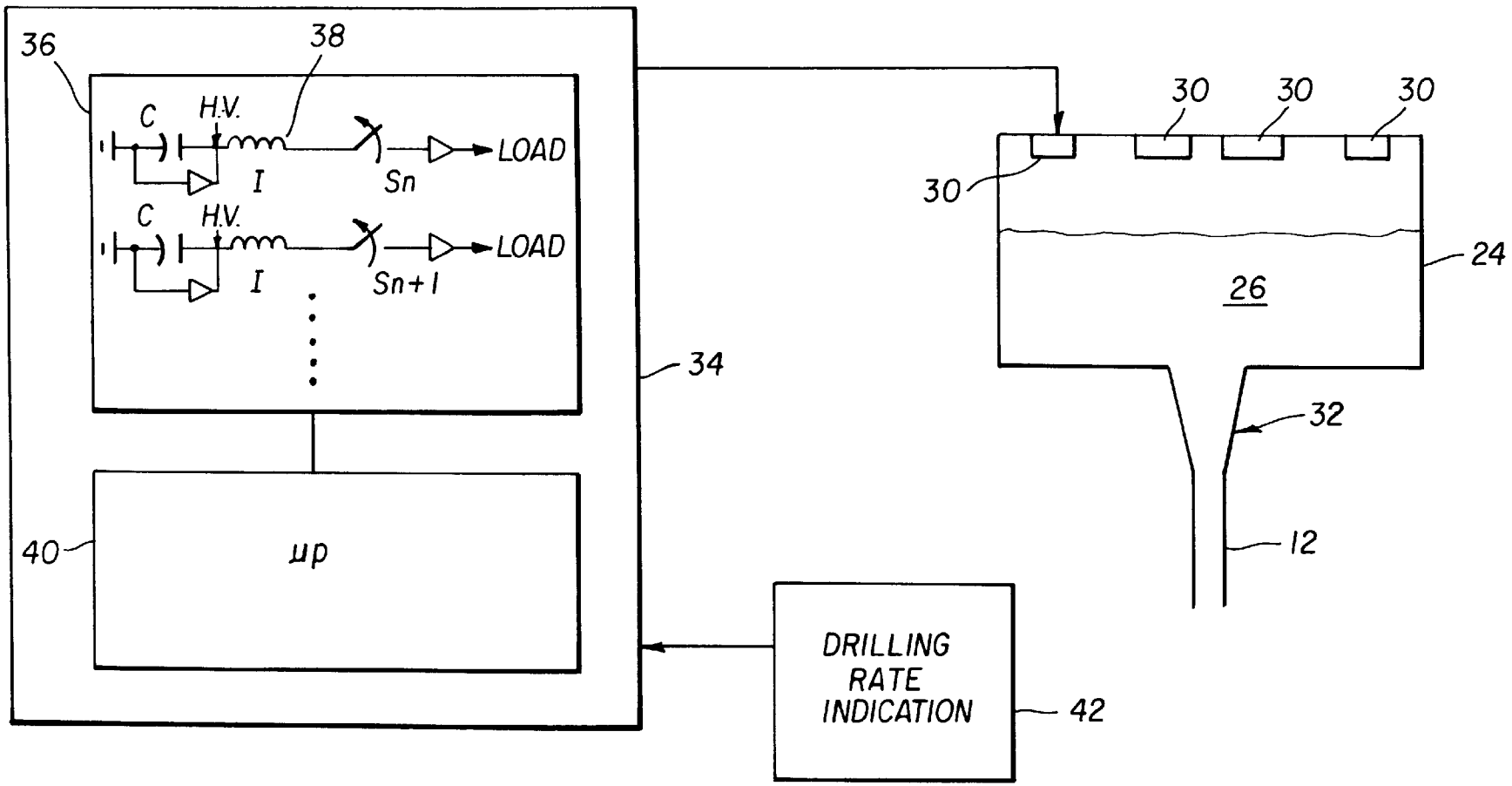
FIG. 4 is a schematic diagram illustrating a traveling wave generator.

FIG. 4 illustrates one example of a traveling wave generator 16 of the type that can be employed. A gas chamber 24 is provided for applying pressure to the drilling fluid 26 contained in the drill string 12. A gas provided in the chamber 24, preferably nitrogen or helium, is heated by a heating element 30 that may include, for example, a heating coil, a plurality of spark gaps or a combination of both.

Figure 5:
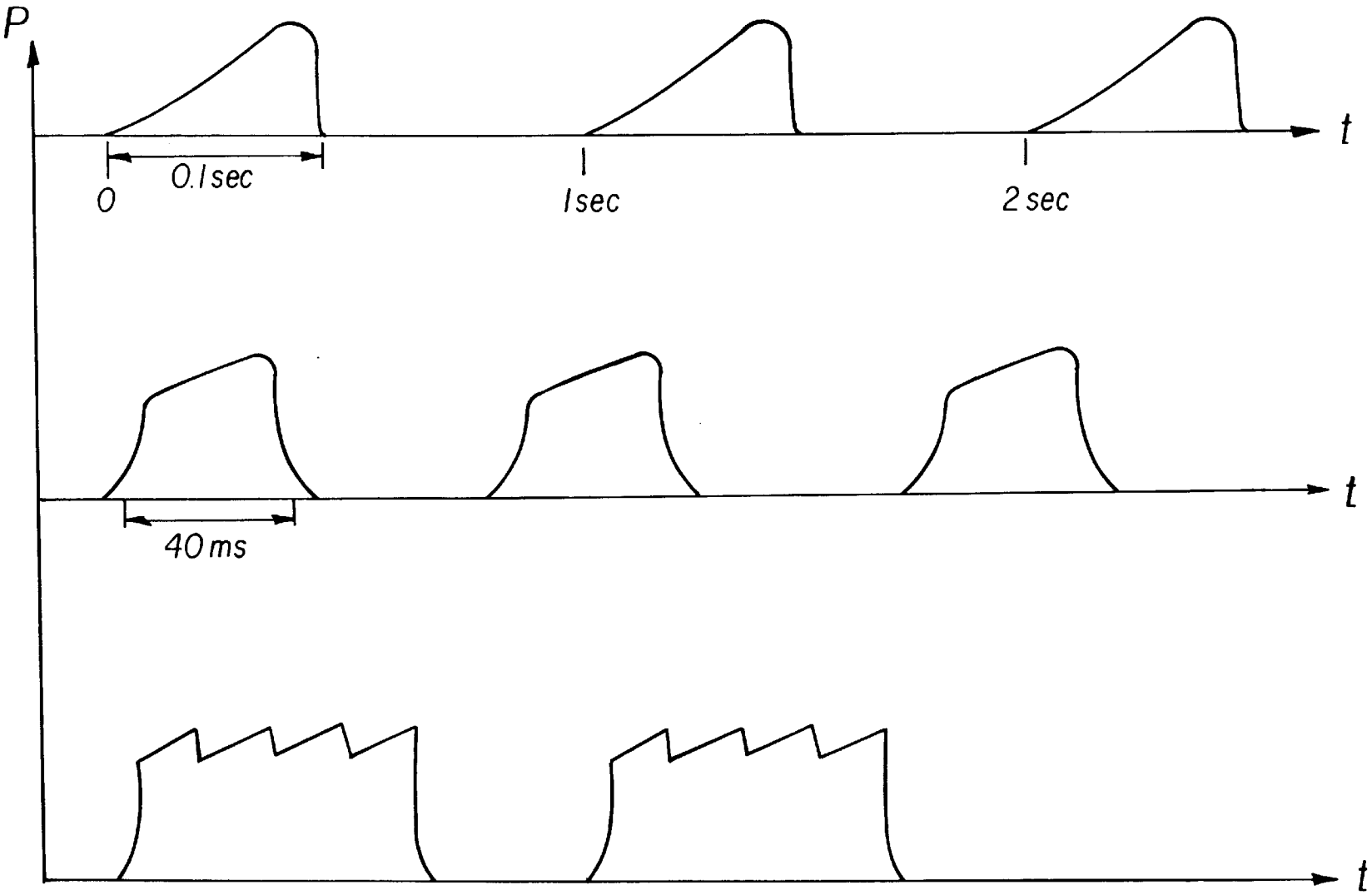
FIG. 5 illustrates alternative ramped pressure pulses generated by the traveling wave generator of FIG. 4.

Preferably, the surface area of the drilling fluid 26 is much greater than the cross-sectional area of the outlet 32 of the gas chamber 24, such that the application of a pressure to the surface of the drilling fluid by the expansion of heated gas is magnified at the outlet 32. A pulse generating control unit 34 is coupled to the heating element 30 that includes a pulse forming network 36 having a plurality of pulse switching circuits 38. Timing of the operation of the pulse switching circuits 38 is controlled by a microprocessor 40, which controls the operation of the pulse switching circuits 38 to ramp power as a function of timed squared in order to generate a series of ramped pressure pulses of the type shown in FIG. 2 or other types as illustrated in FIG. 5.

It is desirable to adjust the timing of the application of the ramped pressure pulses as drilling proceeds to keep the formation of the shock wave properly located to have maximum impact on the drilling substrate. Although complex algorithms can be employed to calculate the required timing sequence in theory, such algorithms may not account for all possible variables in real world situations. Instead, a preferred method of adjusting pulse timing, either in width or frequency or both, to insure that maximum drilling efficiency is achieved utilizes feedback of drilling rate data to the pulse generating control unit 34 by an automated drilling rate indicator 42 or by manual input. In operation, a default initial timing is set such that the shock wave will be formed at a location prior to the surface of the drilling substrate. The pulse generating control unit 34 then adjusts the timing to move the formation point of the shock wave progressively further. At the same time, a drilling rate indicator 42 provides information on the drilling rate to the control unit 34. The drilling rate will increase as the shock wave formation point nears the location of maximum drilling efficiency and will decrease if the formation point passes the location of maximum drilling efficiency. Accordingly, by monitoring the peak drilling rate, the control unit 34 can adjust the timing of the ramped pressure pulses to follow the progress of the drilling head 14 during the drilling operation.

It should also be noted that the application of the ramped pressure pulse to the drill string 12 may cause the drill string 12 to be temporarily pulled upward due to tensile wave pulses. However, the movement of the drill string 12 may actually prove to be beneficial as the tensile wave pulses can be timed with the ramped pressure pulses to cause relief and then compression of the drilling substrate. Further, the drilling substrate will effectively be hit with hammer blows of the drill bit as the drilling fluid transfers momentum to the drill bit.

The invention provides numerous advantages over conventional drilling systems. In assisted drilling, the invention provides an improved drilling process by providing a high pressure jet 22 that clears cut pieces of substrate from the path of the drill bit and/or cuts into the drilling substrate, and that fractures or weakens the drilling substrate by the inducement of vibrations therein with a shock wave without the problems associated with conventional waterjet drilling systems. High pressure is achieved at the fluid jet by the application of a ramped pressure pulse to the drilling fluid contained in the drill string 12 by the traveling wave generator 16 located above the surface of the drilling substrate, which allows the traveling wave generator 16 to be shut down for service of maintenance without interrupting normal drilling operations. In addition to assisted drilling, the invention is applicable to a fluid jet head that directly drills bore holes. For example, the fluid jets 22 can be utilized to bore holes with diameters on the order of 4 cm as compared with the approximately 20 cm required by conventional technology. Still further, the invention can be utilized to generate an acoustic wave at the location of the drilling head that can be measured by a surface monitor to determine the structure of the drilling substrate. Still further, by adjusting the pressure pulse timing, it is possible to cause the shock wave to run up and down the drill string 12 to thereby de-wax deposits formed along the drill string 12 by the shock and heat generated by the shock wave.

The invention has been described with reference to certain preferred embodiments thereof. It will be understood, however, that modifications and variations are possible within the scope of the invention. For example, although nitrogen and helium are the preferred gases utilized in the gas chamber due to the properties of these gases, other gases may be readily employed in the gas chamber. Other methods of heating the gas may also be employed other than heating coils or spark gaps.

What is claimed:

1. A drilling apparatus comprising:

a drill string;

a drilling head located at a first end of the drill string adjacent a drilling surface;

a drilling fluid pump located at a second end of the drill string, wherein the drilling fluid pump pumps a drilling fluid along the length of the drill string to the drilling head; and a traveling wave generator coupled to the drill string at a location downstream of the drilling fluid pump, wherein the traveling wave generator applies a series of ramped pressure pulses to the drilling fluid that are compressed and magnified in amplitude to produce a high energy shock wave at the drilling surface.

2. A drilling apparatus as claimed in claim 1, wherein the drilling head includes at least one drill bit and at least one fluid pressure jet through which the drilling fluid exits the drilling head.

3. A drilling apparatus as claimed in claim 1, further comprising means for preventing the ramped pressure pulses from traveling to the drilling fluid pump.

4. A drilling apparatus as claimed in claim 3, wherein the means for preventing the ramped pressure pulses from traveling to the drilling fluid pump comprises a check valve.

5. A drilling apparatus as claimed in claim 1, wherein the ramped pressure pulses are at least three hundred atmospheres above a background pressure provided by the drilling fluid pump.

6. A drilling apparatus as claimed in claim 1, wherein the ramped pressure pulses have a duration of between 10–100 milliseconds.

7. A drilling apparatus as claimed in claim 1, wherein the traveling wave generator is located above a surface of a drilling substrate.

8. A drilling apparatus comprising:

a drill string;

a drilling head located at a first end of the drill string adjacent a drilling surface;

a drilling fluid pump located at a second end of the drill string, wherein the drilling fluid pump pumps a drilling fluid along the length of the drill string to the drilling head; and a traveling wave generator coupled to the drill string at a location downstream of the drilling fluid pump, wherein the traveling wave generator applies a series of ramped pressure pulses to the drilling fluid;

wherein the drill string has an inner diameter that is reduced along its length to cause compression of the ramped pressure pulses producing high energy shock wave which impacts the drilling surface.

9. A drilling apparatus as claimed in claim 8, wherein the ramped pressure pulses are time compressed as they travel along the length of the drill string to the location of the drilling head.

10. A drilling apparatus as claimed in claim 8, wherein the shock wave has a pressure at least ten times greater than the pressure of the ramped pressure pulses.

11. A drilling apparatus as claimed in claim 10, wherein the ramped pressure pulses have a pressure of three hundred atmospheres and the shock wave has a pressure of three thousand atmospheres.

12. A drilling apparatus as claimed in claim 8, wherein the inner diameter of the drill string is reduced from 10.0 cm to 1.0 cm.

13. A drilling apparatus comprising:

a drill string;

a drilling head located at a first end of the drill string;

a drilling fluid pump located at a second end of the drill string, wherein the drilling fluid pump pumps a drilling fluid along the length of the drill string to the drilling head; and a traveling wave generator coupled to the drill string at a location downstream of the drilling fluid pump, wherein the traveling wave generator generates a series of ramped pressure pulses that are applied to the drilling fluid, wherein said traveling wave generator comprises a gas chamber, a heating element located in the gas chamber, and a control unit for controlling the operation of the heating element to generate the ramped pressure pulses.

14. A drilling apparatus as claimed in claim 13, wherein the control unit includes a pulse generation network and a processor for controlling the operation of the pulse generation network.

15. A drilling apparatus as claimed in claim 13, further comprising detection means for detecting a drilling rate of the drill string coupled to the control unit, wherein the control unit controls a timing of the ramped pressure pulses to generate drilling efficiency based on drilling rate data supplied to the control unit by the detection means.

* * * * *